US009638194B2

(12) United States Patent
Wiegman et al.

(10) Patent No.: US 9,638,194 B2
(45) Date of Patent: May 2, 2017

(54) SYSTEM AND METHOD FOR POWER MANAGEMENT OF PUMPING SYSTEM

(71) Applicant: General Electric Company, Schenectady, NY (US)

(72) Inventors: Herman Lucas Norbert Wiegman, Niskayuna (IN); Deepak Aravind, Bangalore (IN)

(73) Assignee: General Electric Company, Niskayua, NY (US)

( * ) Notice: Subject to any disclaimer, the term of this patent is extended or adjusted under 35 U.S.C. 154(b) by 261 days.

(21) Appl. No.: 14/588,473

(22) Filed: Jan. 2, 2015

(65) Prior Publication Data

US 2016/0194942 A1 Jul. 7, 2016

(51) Int. Cl.
*E21B 43/12* (2006.01)
*F04D 15/00* (2006.01)
(Continued)

(52) U.S. Cl.
CPC ..... *F04D 15/0066* (2013.01); *E21B 43/12* (2013.01); *F04B 17/03* (2013.01);
(Continued)

(58) Field of Classification Search
None
See application file for complete search history.

(56) References Cited

U.S. PATENT DOCUMENTS 3,090,439 A 5/1963 Copland et al.
3,264,612 A * 8/1966 Yetter ..... G05B 19/08 307/116
(Continued)

FOREIGN PATENT DOCUMENTS

CN 201273266 Y 7/2009

OTHER PUBLICATIONS

Alonso et al., "The expansion of "non conventional" production of natural gas (tight gas, gas shale and coal bed methane). A silent revolution", Energy Market (EEM), 2010 7th International Conference on the European, IEEE Xplore, pp. 1-8, Jun. 23-25, 2010, Conference Location: Madrid.
(Continued)

*Primary Examiner* — Shane Bomar
(74) *Attorney, Agent, or Firm* — Jason K. Klindtworth

(57) ABSTRACT

A method implemented by at least one processor includes receiving a pressure profile to be generated by a pumping system, wherein the pumping system includes at least one pump-unit powered by at least one generator-unit. The method also includes receiving a pump-unit parameter from at least one pump-unit and a generator-unit parameter from at least one generator unit. The pump-unit parameter is representative of an operating parameter of the pump-unit. The generator-unit parameter is representative of an operating parameter of the at least one generator-unit. The method includes generating an operating set-point corresponding to the at least one generator-unit based on the pump-unit parameter and the generator-unit parameter, wherein the operating set-point is one of at least one operating set-point corresponding to the at least one generator-unit. The method also includes determining an input parameter for the at least one generator-unit based on the at least one operating set-point.

20 Claims, 10 Drawing Sheets

(51) Int. Cl.

| | |
|---|---|
| ***F04B 17/03*** | (2006.01) |
| ***F04B 47/02*** | (2006.01) |
| ***F04B 49/06*** | (2006.01) |

(52) U.S. Cl.

CPC ..... *F04B 47/02* (2013.01); *F04B 49/065* (2013.01); *F04D 15/0077* (2013.01); *F04B 2203/0201* (2013.01)

(56) References Cited

U.S. PATENT DOCUMENTS

| | | | | |
|---|---|---|---|---|
| 4,472,345 | A * | 9/1984 | Tanji | G21D 3/14 376/211 |
| 7,901,314 | B2 | 3/2011 | Salvaire et al. | |
| 8,622,124 | B2 | 1/2014 | Eslinger | |
| 8,789,601 | B2 | 7/2014 | Broussard et al. | |
| 2012/0255734 | A1 | 10/2012 | Coli et al. | |
| 2013/0018605 | A1* | 1/2013 | Peterson | G01F 25/0061 702/55 |
| 2014/0010671 | A1 | 1/2014 | Cryer et al. | |
| 2014/0096974 | A1 | 4/2014 | Coli et al. | |
| 2015/0078917 | A1* | 3/2015 | Torrey | F04D 15/0066 417/42 |
| 2016/0160862 | A1* | 6/2016 | Torrey | F04D 15/0066 417/44.1 |

OTHER PUBLICATIONS

Yongming et al., "Unsteady Flow Model for Fractured Gas Reservoirs", 2010 International Conference on Computational and Information Sciences (ICCIS), IEEE Xplore, pp. 692-695, Dec. 17-19, 2010, Conference Location: Chengdu.

* cited by examiner

SYSTEM AND METHOD FOR POWER MANAGEMENT OF PUMPING SYSTEM

BACKGROUND

A system and method are disclosed for management of motor driven pumps. Specifically, the techniques are disclosed for efficient operation of a plurality of motor driven pumps powered by one or more prime movers.

Hydraulic fracturing is used to generate production from un-conventional oil and gas wells. The technique includes pumping of fluid into a wellbore at high pressure. Inside the wellbore, the fluid is forced into the formation. Pressurized fluid entering into the formation creates fissures releasing the oil or gas. The fluid such as water or gas together with solid proppants is introduced into the fissures to sustain the release of oil or gas from the formation. The pumping is performed using boost and fracturing pumps which are powered by large diesel generators. More than one pump may be operating in an oil well and one or more diesel generator may be used to provide power to these multiple pumps.

Electric motor driven pumps such as fracturing pumps are used to generate required wellhead pressure. A conventional system in the oil and gas industry employs a variable speed drive (VSD) that is fed by a fixed frequency AC supply to drive a single fracturing pump. Conventional techniques require a dedicated diesel engine and a dedicated VSD for each fracturing pump. A typical application may include about 16 pumps dedicated to one well head for fracking.

The excessive volumes of diesel fuel for pumping operation necessitates constant transportation of diesel tankers to the site and results in significant carbon dioxide emissions. Attempts to decrease fuel consumption and emissions by running large pump engines on "Bi-Fuel", blending natural gas and diesel fuel together, have met with limited success. The dispatching of a plurality of prime movers for providing a required pressure profile may not be optimum. Thus, load balancing depends on the availability or non-availability of prime movers and one or more pumps. The operation of the plurality of pumps for each well head also may not be efficient in terms of fuel consumption. During the pumping operation, possibility of failure of one or more pumps necessitates unscheduled maintenance.

Various opportunities exist to minimize the run time of the prime movers and to optimize other aspects of the operation of the prime movers. There exists a need to proactively determine the fault conditions and determine performance of individual motor driven pumps of a fracking system for planned maintenance and protection of the motor driven pumps. Further, improved techniques for management of a plurality of motor driven pumps powered by a plurality of prime mover driven generators are desirable.

BRIEF DESCRIPTION

According to one aspect of the disclosed technique, a method is disclosed. The method includes receiving a pressure profile to be generated by a pumping system, wherein the pumping system includes at least one pump-unit powered by at least one generator-unit. The method also includes receiving a pump-unit parameter from at least one pump-unit, wherein the pump-unit parameter is representative of an operating parameter of the pump-unit. The method further includes receiving a generator-unit parameter from at least one generator unit, wherein the generator-unit parameter is representative of an operating parameter of the at least one generator-unit. The method includes generating an operating set-point corresponding to the at least one generator-unit based on the pump-unit parameter and the generator-unit parameter, wherein the operating set-point is one of at least one operating set-point corresponding to the at least one generator-unit. The method also includes determining an input parameter for the at least one generator-unit based on the at least one operating set-point.

In accordance with another aspect of the present technique, a system is disclosed. The system includes at least one processor and a memory communicatively coupled to the at least one processor via a communications bus. The system includes a signal acquisition module communicatively coupled to a pumping system having at least one pump-unit powered by at least one generator-unit. The signal acquisition module acquires a pump-unit parameter from a pump-unit and a generator-unit parameter from a generator-unit. The system further includes a set-point generator communicatively coupled to the signal acquisition module to determine an operating set-point based on the pump-unit parameter and the generator-unit parameter. The operating set-point generator is one of at least one operating set-point corresponding to the at least one generator-unit. The system also includes a power management module communicatively coupled to at least one set-point generator to receive the at least one operating set-point and determine an input to a generator-unit. In the system, at least one of the signal acquisition module, the set-point generator and the power management module is stored in the memory and executable by at least one processor.

In accordance with another aspect of the present technique, a non-transitory computer readable medium having a program is disclosed. The program instructs at least one processor to receive a pressure profile to be generated by a pumping system, wherein the pumping system comprises at least one pump-unit powered by at least one generator-unit. The program further instructs the at least one processor to receive a pump-unit parameter from the at least one pump-unit, wherein the pump-unit parameter is representative of an operating parameter of the pump-unit. The program also instructs the at least one processor to receive a generator-unit parameter from the at least one generator unit, wherein the at least one generator-unit parameter is representative of operating parameters of the generator-unit. The program further instructs the at least one processor to generate an operating set-point corresponding to the at least one generator-unit based on the pump-unit parameter and the generator-unit parameter, wherein the operating set-point is one of at least one operating set-point corresponding to the at least one generator-unit. The program also instructs the at least one processor to determine an input parameter for the at least one generator-unit based on the at least one operating set-point.

DRAWINGS

These and other features, aspects, and advantages of the present invention will become better understood when the following detailed description is read with reference to the accompanying drawings, wherein.

DETAILED DESCRIPTION

The embodiments described herein are directed to management of operation of a distributed pumping system. Specifically, the management of operation of the distributed pumping system includes power management of a plurality of generator-units, performance assessment and protection of a plurality of pump-units. The technique includes receiving a pump-unit parameter from the at least one pump and a generator-unit parameter from the at least one generator-unit. An operating set-point is determined based on the motor-unit parameter and the generator-unit parameter.

The term 'dispatching' used herein refers to scheduling the operation of a plurality of prime movers to produce the desired energy at the lowest fuel cost. The term 'pressure profile' referred herein means a desirable power output (or a pressure of working fluid) as a function of time for a specific purpose such as a fracking a formation at a site. The term 'pump-unit' refers to a conventional mechanical pump driven by an electric motor or any other mechanism to create desirable pressure of the working fluid at a fracturing site. The term 'generator-unit' refers to a prime mover such as a diesel engine coupled to an electrical generator and generating electric power to drive the pump. The term 'operating parameter' refers to an electrical parameter or a mechanical parameter associated with an electrical machine such as motor or generator and a mechanical pump. The term 'operating set-point' refers to a description of operating condition of a machine through a plurality of operating parameters at a given instant of time. The term 'input parameters' refers to quantity of a parameter such an electric current, electric voltage, fuel amount, electric power provided to an operating machine. The quantity of a parameter that is generated by an operating machine is referred herein as 'output parameter'. The terms 'pump-unit parameter', 'generator-unit parameter', 'generator parameter', 'motor parameter', and 'pump parameter' refer to parameter associated with a pump-unit, a generator-unit, a generator, a motor and a pump respectively. The term 'model' used herein refers to a mathematical model, a simulator model, or any other prototype used to represent the overall system comprising a plurality of pumps powered by a plurality of prime movers.

Figure 1:
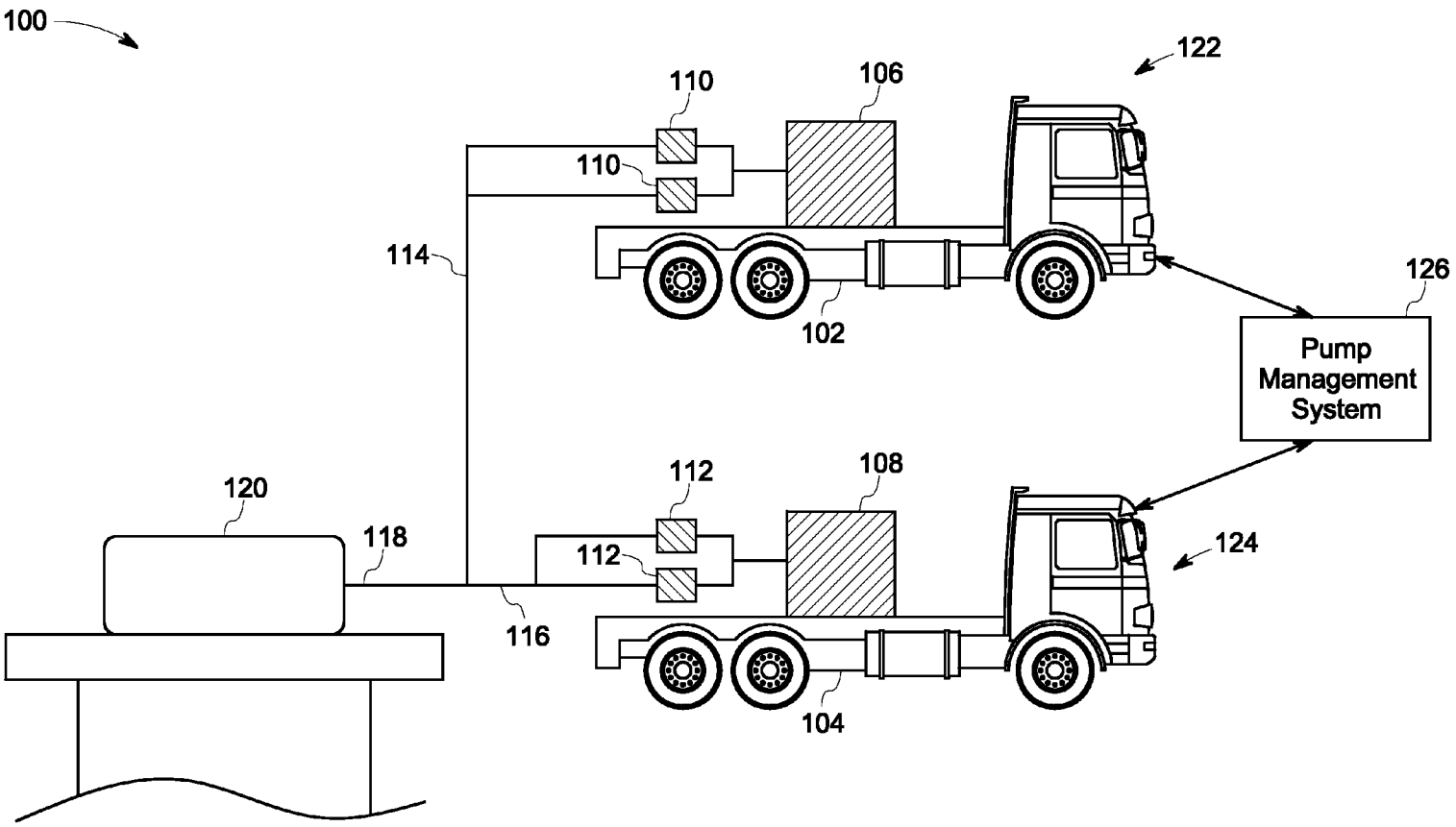
FIG. 1 illustrates a distributed pumping system having a plurality of pump-units driven by a plurality of generator-units in accordance with an exemplary embodiment.

FIG. 1 illustrates a distributed pumping system 100 having a plurality of vehicles 102, 104 fitted with a plurality of pumping systems 122, 124. The pumping systems 122, 124 move between different locations within a formation site. Each of the pumping systems 122, 124 includes a generator-unit powering a plurality of pump-units to generate pressurized stream of fluid. In the illustrated embodiment, the pumping system 122 mounted on the vehicle 102, includes a generator-unit 106, and multiple motor pump-units 110. The pumping system 124 includes a generator-unit 108, and a plurality of pump-units 112. In one embodiment, each of the vehicles 102, 104 may have one generator-unit driving a single pump-unit. The generator-units 106, 108 having a prime mover such as a diesel engine coupled to a generator, convert kinetic energy to generate electric power. Each of the pump-units 110, 112 having an electrical motor driving a mechanical pump, operate on a fluid to provide pressurized fluid. The pump-units 110 provide pressurized fluid to a conduit 114 and the pump-units 112 provide pressurized fluid to a conduit 116. Conduits 114, 116 are coupled to a manifold 118 directing the pressurized fluid to the pumping location 120. The system 100 is distributed among the plurality of vehicles 102, 104 and one or more of the prime mover, generators, a plurality of motors, a plurality of pumps, or a plurality of pump-units may be disposed on each of the plurality of vehicles. The distributed pumping system 100 is provided with a pump management system 126 disclosed herein.

The pump management system 126 is communicatively coupled to the system 100 and configured to control and monitor the operation of the respective pumping systems 122, 124 respectively. The pump management system 126 is a distributed system having at least one processor in each of the pumping systems 122, 124. Specifically, the system 126 performs dispatching of the plurality of prime movers of the generator-units 106, 108 for optimizing the fuel consumption and other operational costs. The system 126 determines the health of various components of the pumping system and predicts operating conditions and failures of the system 100. The operating conditions may be used for recommending the maintenance schedules. The information generated by the system 126 is useful for the operators to understand the operating efficiency of the system and decide about initiating manual actions optimizing of the system operation. The information from the system 126 may also help the operator to determine the repair and replacement of components in a pumping system before initiating the pumping operation in a new site. During the operation, the information from the system 126 may be useful to deploy backup pumping systems for continued operation. Further, the system 126 determines a desirable operating condition based on imminent failures and initiates control actions that protect a plurality of pump-units of the distributed pumping system 100 from electrical and mechanical overloading conditions.

Figure 2:
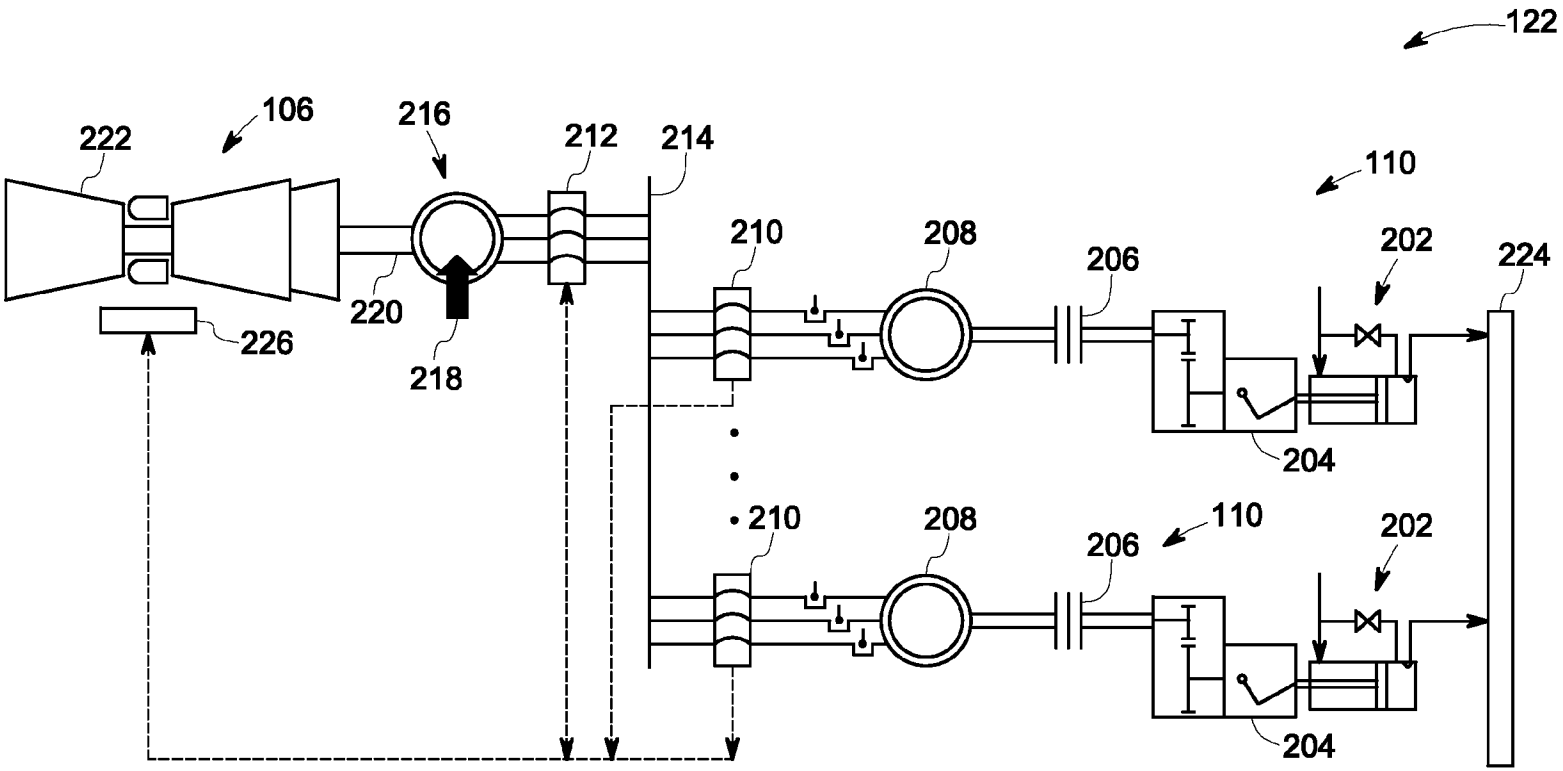
FIG. 2 illustrates a pumping system having plurality of pump-units powered by a single generator-unit in accordance with an exemplary embodiment.

FIG. 2 illustrates the pumping system 122 mounted on one vehicle includes a single generator-unit powering a plurality of pump-units in accordance with an exemplary embodiment. Each pump-unit 110 of the pumping system 122 includes a pump 202 driven by a corresponding electric motor 208. A speed sensor 206 is disposed in each of the pump-units 110 to measure motor shaft speed. The electric motors are powered from a shared electrical bus 214 that is supplied by a single generator-unit 106 having a prime mover 222 mechanically coupled to an electric generator 216 via a drive shaft 220. In one embodiment, the generator-unit provides an AC power to the plurality of pump-units. In another embodiment, the generator-unit provides a DC power to the plurality of pump-units. The prime mover includes a fuel based engine or other controllable source of rotational energy. In some embodiments, the prime mover 222 may be one of a gas turbine generator, a diesel engine, or a reciprocating engine that is fueled by a suitable fuel such as natural gas, or diesel fuel. In one embodiment, the prime mover 222 may use the gas produced from the well for driving the generator. In such an embodiment, the consumption of diesel by the diesel generator may be reduced achieving fuel savings upto 20%. The magnitude of the voltage output by the electric generator 216 is generally, but not necessarily, proportional to the rotation speed of the prime mover driveshaft. Each electric motor 208 operates at the same frequency and/or voltage to supply power to the plurality of pumps 202

In one embodiment, output pumping power is controlled by a system controller 226 controlling the prime movers throttle or fuel input controller. The rotation speed of the drive shaft of the prime mover 222 is used as a control input via generator control 218 to control the generator voltage. The control of electric motors is based on feedback and/or feed forward information of parameters such as, without limitation, wellhead pressure, and pumping load flow. In one embodiment, the throttle control mechanism may be manually operated by an operator having knowledge of pumping load characteristics. In other embodiments, the pumping speed or the electrical frequency of the pump may be controlled by using a controller. In another embodiment, the throttle control may be remotely operated from a controller which receives a command from an operator intending to control the wellhead pressure and/or pumping load flow rate remotely. In one aspect of the invention, the throttle control mechanism relies on feedback from the electrical generator, the plurality of electrical motors, and the plurality of mechanical pumps.

In the illustrated embodiment, the plurality of reciprocating pumps together operate to provide a combined pressure in a common manifold/conduit 224. In another embodiment, each of the plurality of electrical motors may be mechanically coupled via a transmission and corresponding gearbox to a single reciprocating pump to generate the desired pressure in the common high pressure manifold/conduit 224. The wellhead pressure may be monitored via a pressure sensor at or near the wellhead. In another embodiment, the well head pressure may be estimated based on the multiple pressure values corresponding to each respective conduit pressure(s) measured at the respective conduit(s).

The pumping system 122 includes a plurality of local protection relays 210 corresponding to the plurality of pump-units 110. The system 122 also includes a system protection relay 212 for protecting the system against predetermined overload, over speed and other fault conditions that may occur during operation of the system. The local protection relays 210, the system protection relay 212, and the system controller 226 are communicatively coupled and operate in a coordinated fashion. A plurality of relay parameters from the local protection relays 210 and system protection relay 212 are used to determine a desirable generator set-point. In one embodiment, relay parameters from the local protection relays 210 are processed by the system protection relay 212. In another embodiment, relay parameters from the local protection relays 210 and relay parameters of the system protection relay 212 are received and processed by the system controller 226. One or more inputs of the generator-unit may be modified based on the desirable generator set-point to optimize the operation of the generator-unit 106. On or more control actions is also generated by processing of the relay parameters from the local protection relays 210, system protection relay 212

Figure 3:
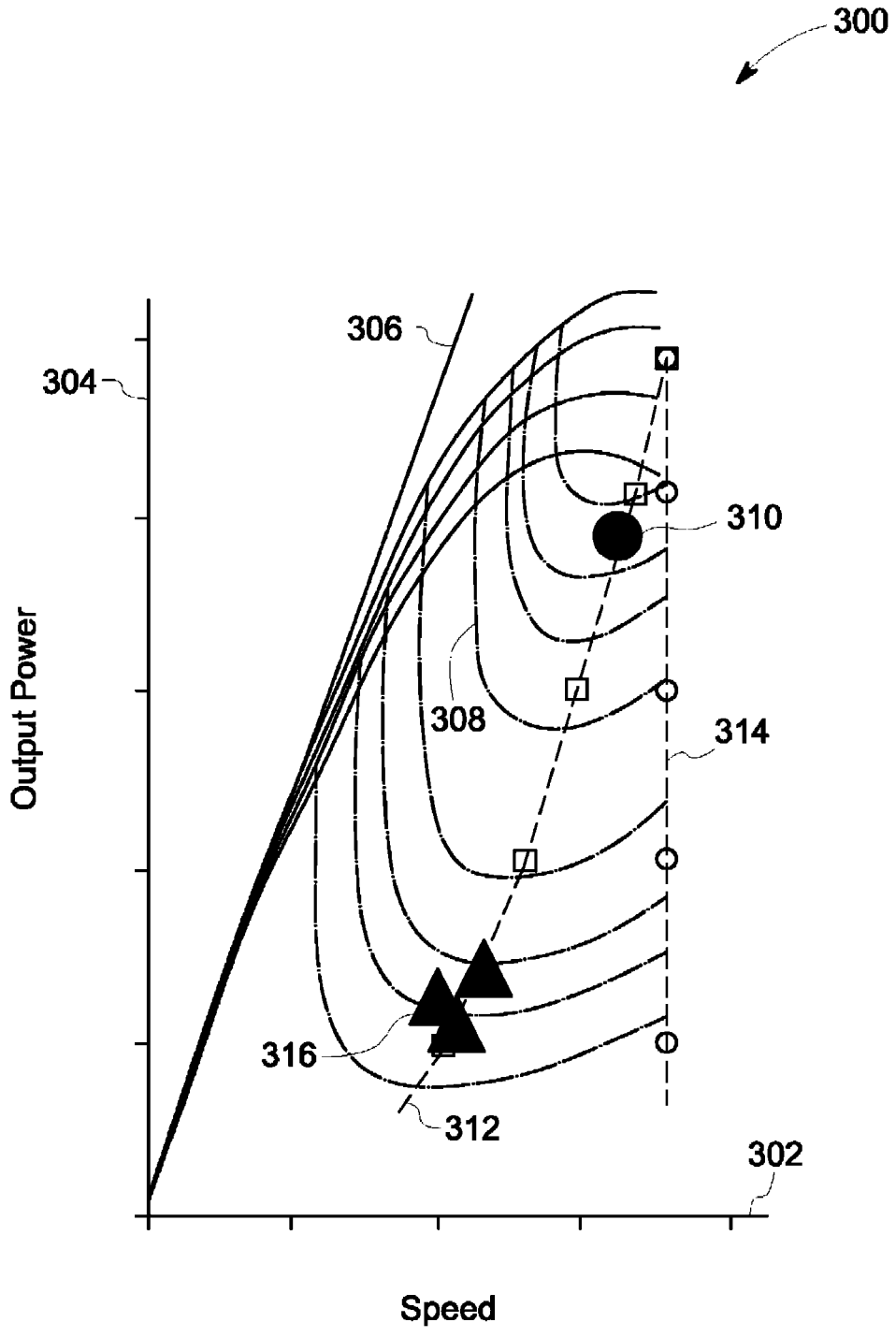
FIG. 3 is a graph illustrating efficient dispatching of multiple generator-units in accordance with an exemplary embodiment.

FIG. 3 is a graph 300 illustrating efficient dispatching of multiple prime movers in accordance with an exemplary embodiment. The graph 300 has an x-axis 302 representative of speed of the prime mover. The graph 300 also has a y-axis 304 representative of output power of the prime mover. A plurality of solid lines 306 of the graph 300 are representative of output power curves and a plurality of dashed lines 308 are representative of fuel efficiency curves of the prime mover. The graph 300 also includes a line 312 representative of variation of output power and fuel efficiency for a variable speed operation. The graph 300 also illustrates a line 314 representative of variation of output power and fuel efficiency for constant speed operation. It may be observed that a single prime mover operating near a full load is more efficient 310 compared to a plurality of prime movers operating at a partial load 316. The disclosed embodiments provide techniques for dispatching a plurality of prime movers to operate with optimum fuel efficiency.

Figure 4:
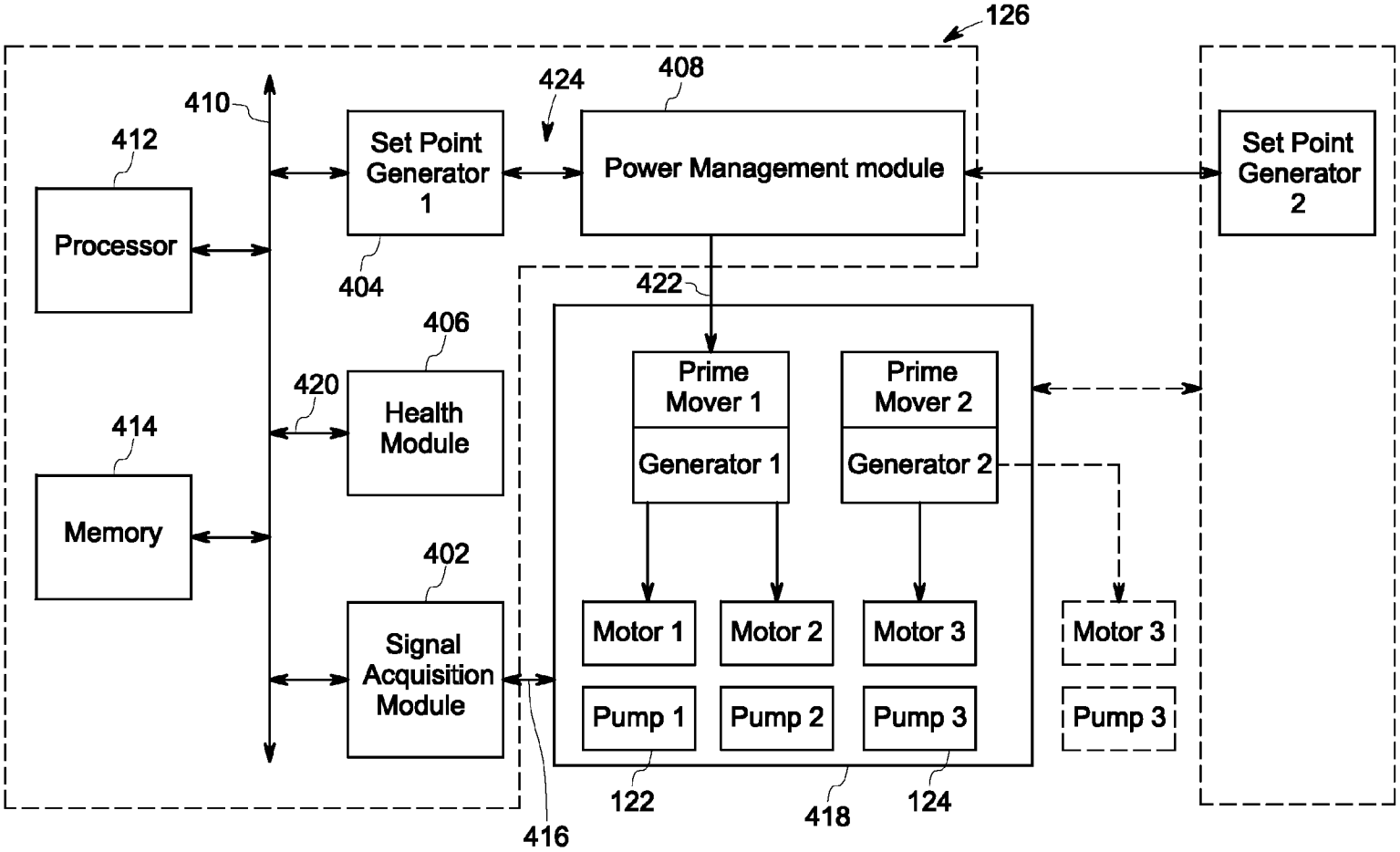
FIG. 4 is a system for efficient operation of the distributed pumping system in accordance with an exemplary embodiment.

FIG. 4 is a pump management system 126 communicatively coupled to the distributed pumping system 418 for power management, monitoring, and protection of subsystems and components of the system 126. The pump management system 126 includes a signal acquisition module 402, a set-point generator module 404, a health module 406, a power management module 408, a processor 412, and a memory module 414. The modules of the system 126 are communicatively coupled to each other by means of a communications bus 410.

The signal acquisition module 402 communicatively coupled to at least one pump-unit and at least one generator-unit, acquires a plurality of operating parameters 416 from the pumping system 418. The plurality of operating parameters 416 include a pump-unit parameter corresponding to the at least one pump-unit and a generator-unit parameter corresponding to the at least one generator-unit. The pumping system 418 includes at least one pump-unit powered by at least one generator-unit. It should be noted that in general, the distributed pumping system 418 includes multiple vehicle mounted pumping systems 122, 124 each having groups of pump-units powered by a separate generator-unit. Each pump-unit includes an electric motor driving a mechanical pump. The generator-unit includes a prime mover powering an electrical generator to generate electrical power to be supplied to the plurality of motors. In one embodiment, the signal acquisition module 402 receives a generator-unit parameter comprising at least one a speed value, a power value, a voltage value, and a current value from one of the at least one generator-unit. A plurality of generator-unit parameters are generated by a plurality of generator-units of the pumping system. The signal acquisition module 402 also receives the pump-unit parameter comprising an injection pressure value, and a flow value. A plurality of pump-unit parameters are generated by a plurality of pump-units of the pumping system.

In one exemplary embodiment, the signal acquisition module 402 estimates the pump-unit parameter and the generator-unit parameter based on a pumping system model.

The pumping system model includes mathematical or simulation models of the prime movers, generators, motors and pumps. The pumping system model is designed to estimate a plurality of parameters of the prime movers, generators, motors and pumps in known operating conditions. The pumping system model is calibrated periodically based on the measurements from the pumping system and in some embodiments; the calibration is being performed in real time.

The set-point generator module 404 communicatively coupled to the signal acquisition module 402, determines an operating set-point 424 based on the pump-unit parameter and the generator-unit parameter. In one embodiment, the set-point generator module 404 determines at least one of an operating pressure, an operating flow corresponding to the at least one pump. The operating set-point refers to a description of the distributed pumping system in terms of a plurality of generator parameters, a plurality of pump parameters, and a plurality of motor parameters. In one embodiment, the set-point generator module 404 determines a desired set-point corresponding to the received pressure profile based on the operating set-point and the plurality of parameters.

The health module 406 communicatively coupled to the signal acquisition module, determines a plurality of health parameters 420 based on the plurality of operating parameters 416. The health module determines a health index based on the plurality of health parameters 420. The health module also predicts one or more of the plurality of health parameters 420 at a future time instant based on a plurality of health parameters corresponding to present and past time instants. The health module performs data processing and computations using the health index at the future time instant for determining a failure indicator corresponding to a pump-unit failure. The health module detects an over current condition, an over voltage condition, and an insulation failure condition. The health module further initiates a control action based on the failure condition. The health module then performs at least one of a power management, speed control, and an excitation current control. The health module is capable of determining a health index corresponding to the at least one pump-unit based on the plurality of health parameters. The health module is further able to compute a product of the plurality of health parameters, as implemented by a multiplier circuit or as a software routine.

In one embodiment, the pump-unit failure includes at least one of a pump failure, and a motor failure. The pump failure may include, but not limited to, a mechanical failure, and a bearing failure. The motor failure includes, but not limited to, a bearing failure, a rotor failure, an electrical failure, and a mechanical failure. The electrical failure of a motor includes an over current condition and an over voltage condition.

The health module is also configured to protect the pumping system from destruction. In one embodiment, the health module determines at least one of an excessive current condition, an excessive voltage condition, and an excessive speed condition representative of a back spin condition of a pump-unit. The back spin condition of a pump-unit may be due to at least one of a pump failure, a motor failure, and a mechanical failure of a pump or a motor. The health module is compares the pump-unit parameter with a corresponding pump-unit parameter threshold value. In one embodiment, the pump-unit parameter threshold value is determined based on the reference data. In another embodiment, the health module performs a signature analysis of the pump-unit parameter to extract useful information for determining a failure condition.

In one embodiment, a plurality of operating parameters corresponding to the plurality of pump-units are compared continuously to determine a fault condition. For example, an average value or an energy value corresponding to a plurality of samples of an operating parameter may be computed over a short window of time for each of the pump-units. A plurality of energy values of each pump-unit are compared with corresponding values of other pump-units to determine a relative variation. The health module determines a failure condition based on a comparison of the relative variation with a fault threshold. Determining a failure condition based on a single pump-unit utilizes a high fixed threshold value, whereas determining the failure condition based on a plurality of pump-units utilizes a much smaller threshold value enhancing the sensitivity of the failure detection. The health module determines an operating set-point for the generator-unit based on the failure condition.

The power management module 408 is communicatively coupled to at least one set-point generator module 404 for receiving corresponding at least one operating set-point 424 and determines a generator-unit input parameter 422 corresponding to the at least one generator-unit. In one embodiment, the power management module determines an optimal fuel input to the at least one prime mover. In another embodiment, the power management module determines an optimal speed of the prime mover. In another embodiment, the power management module also determines an optimal value of excitation/field current of the at least one generator. In one embodiment, the power management module determines the extent of usage of the diesel engine based on the production from the well.

The processor module 412 includes any suitable programmable circuit which may include one or more systems and microcontrollers, microprocessors, reduced instruction set circuits (RISC), digital signal processors (DSPs), application specific integrated circuits (ASIC), programmable logic circuits (PLC), field programmable gate arrays (FPGA), and any other circuit capable of executing the functions described herein. The above examples are exemplary only, and thus are not intended to limit in any way the definition and/or meaning of the term "processor."

In the exemplary embodiment the processor module 412 includes a plurality of control interfaces that are coupled to prime mover throttle or fuel input controls/mechanisms to control a fuel flow rate for respective prime mover. In addition, processor module 412 also includes a sensor interface that is coupled to at least one sensor that may transmit a signal continuously, periodically, or only once and/or with any other timing pattern that enables the processor module 412 to function as described herein. Moreover, the sensors may transmit a signal either in an analog form or in a digital form.

The processor module 412 may also include a display and a user interface. The display, according to one embodiment, includes a vacuum fluorescent display (VFD) and/or one or more light-emitting diodes (LED). Additionally or alternatively, the display may include, without limitation, a liquid crystal display (LCD), a cathode ray tube (CRT), a plasma display, and/or any suitable visual output device capable of displaying graphical data and/or text to a user.

Various connections are available between the processor module 412 and each throttle or fuel input control/mechanism. Such connections may include, without limitation, an electrical conductor, a low-level serial data connection, such as Recommended Standard (RS) 232 or RS-485, a high-level serial data connection, such as Universal Serial Bus (USB) or Institute of Electrical and Electronics Engineers (IEEE) 1394 (a/k/a FIRE WIRE), a parallel data connection, such as IEEE 1284 or IEEE 488, a short-range wireless communication channel such as BLUETOOTH, and/or a private network connection, whether wired or wireless.

The memory module 414 includes a computer readable medium, such as, without limitation, random access memory (RAM), flash memory, a hard disk drive, a solid state drive, a diskette, a flash drive, a compact disc, a digital video disc, and/or any suitable device that enables the processor to store, retrieve, and/or execute instructions and/or data. In one embodiment, the memory module 414 is a non-transitory computer readable medium encoded with a program to instruct at least one processor to perform tasks desired for power management, performance assessment and pump protection.

Exemplary embodiments of the pump management system 126 include storing at least one of the signal acquisition module 402, set-point generator module 404, health module 406, and the power management module 408 in memory module 414 and executed using the processor module 412. In some embodiments, at least one of the modules 402, 404, 406, 408 may be a standalone hardware module, or a special purpose hardware unit and one of more of these modules may be co-located or distributed in an area of operation of the pumping system.

Figure 5:
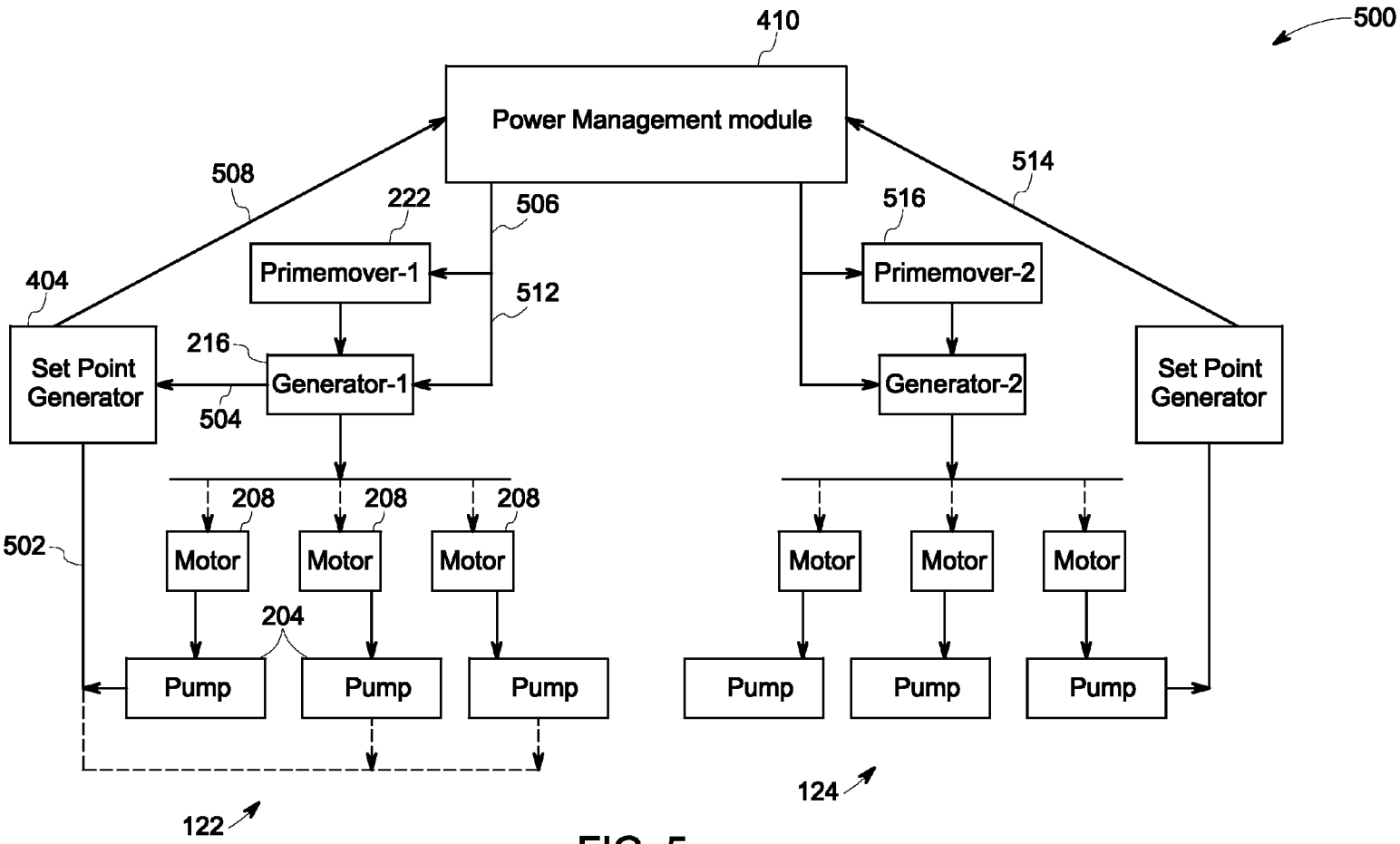
FIG. 5 is a schematic representation of power management technique for the distributed pumping system in accordance with an exemplary embodiment.

FIG. 5 is a schematic 500 of working of a power management system 126 involving a plurality of pump-units powered by a plurality of generator-units in accordance with an exemplary embodiment. The schematic 500 illustrates a pumping system 122 having a plurality of mechanical pumps 204 providing a pressure measurement 502 to the set-point generator module 404. The set-point generator module 404 also receives one or more mechanical or electrical parameter from the generator 216 and provides an operating set-point 508 to the power management module 408. The power management module 408 also receives operating set-points from other pumping systems such as 124 and performs dispatching of the plurality of prime movers for fuel efficiency. The power management module generates an actuating signal 506 for controlling fuel supply to the prime mover, or to control the speed of the prime mover 222. The power management module also provides an actuating signal 512 for controlling the excitation signal. The power output of the generator 216 is provided to the plurality of electrical motors 208 driving a corresponding mechanical pump 204 of the pumping system 122. It should be noted that working of the pumping system 124 is exactly similar to the working of the pumping system 122. The power management module 408 receives a plurality of operating set-points 508, 514 and determines the dispatching of the plurality of prime movers 222, 516.

In one embodiment, the power management module 408 generates the actuating signal 506 for controlling fuel supply or to control the speed of the prime mover 222 based on a desired operating set-point determined by the health module. In another embodiment, the power management module 408 generates the actuating signal 506 for controlling the fuel supply to or the speed of the prime mover based on a plurality of relay parameters corresponding to the plurality of pump-units and the plurality of generator-units.

Figure 6:
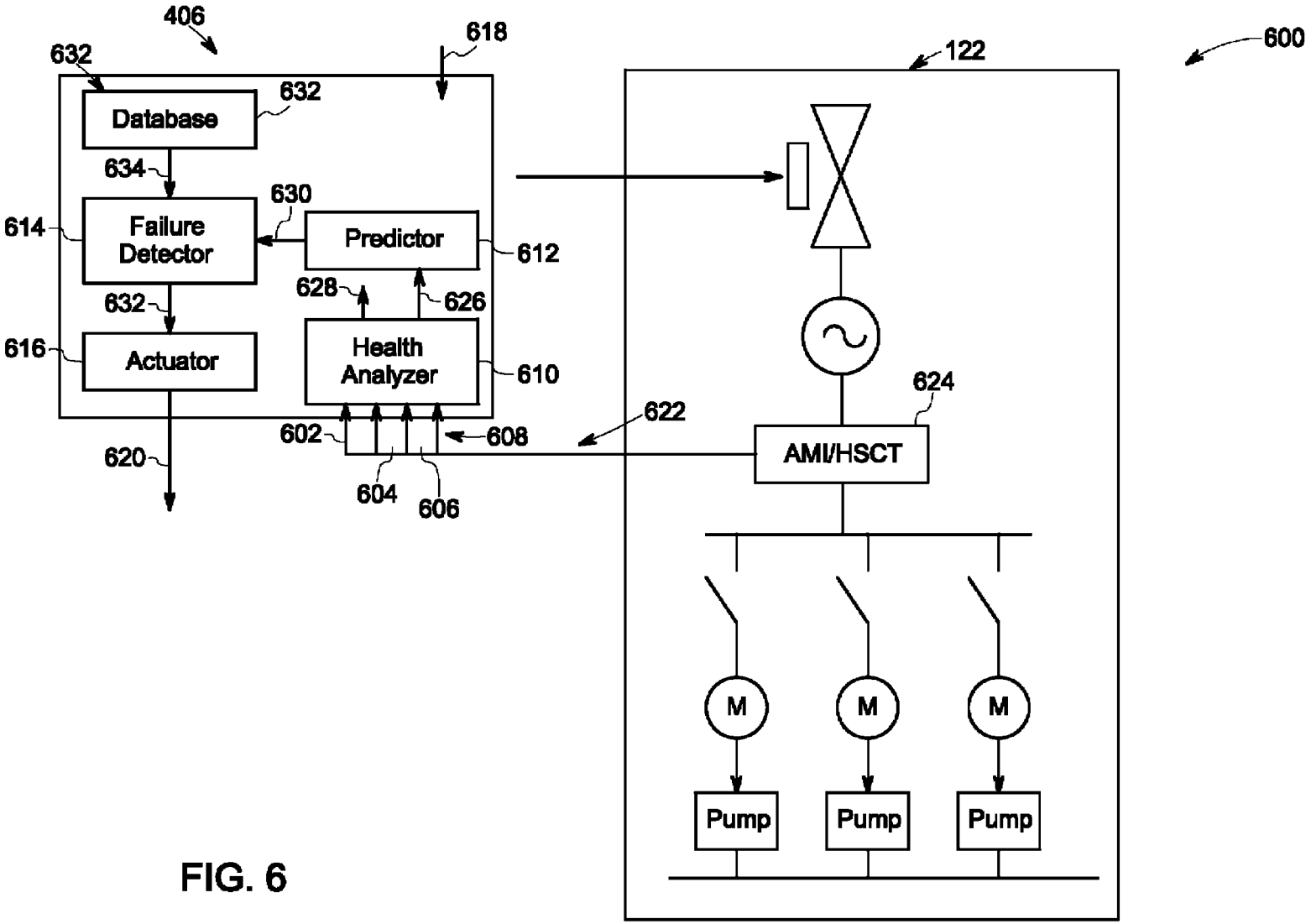
FIG. 6 is a health monitoring system for a pumping system having a plurality of pump-units powered by a generator-unit in accordance with an exemplary embodiment.

FIG. 6 is a schematic 600 illustrating working of a health monitoring system for a plurality of pump-units in accordance with an exemplary embodiment. The schematic shows the pumping system 122 communicatively coupled with the health module 406. The health module 406 includes a health analyzer 610, a predictor 612, a database module 632, a failure detector 614 and an actuator 616. The health analyzer receives a plurality of operating parameters 622 such as, but not limited to, motor current 602, motor voltage 604, wellhead pressure 606, and pump speed 608 from an auto metering instrument (AMI) 624. In one embodiment, the health module 406 also receives one or more input parameters of a generator-unit 618 from energy management module. The health analyzer 610 computes a plurality of health parameters 628 based on the pump-unit parameters and the generator-unit parameters. The health analyzer can also generate a health index 626 based on the plurality of health parameters 628. At least one health parameter is representative of performance of the motor and at least one other parameter is representative of performance of the pump. The predictor 612 is communicatively coupled to the health analyzer 610 and determines various health parameters 628 and/or health indices 626 at a future instant of time based on the present and past values. The failure detector 614 is communicatively coupled to the predictor 612 and determines a failure condition 632 based on the health index 626, one or more of the health parameters 628 and/or their corresponding predictions 630 at the future time instant. In one embodiment, the predictions 630 is performed by using machine learning algorithms. In another embodiment, a least squares based technique may also be used. In alternate embodiment, a model predictive controller may be used generate predictions 630. The failure condition is determined based on the reference data 634 stored in the database 632. The actuator 616 generates a control action signal 620 based on the failure condition 632.

Figure 7:
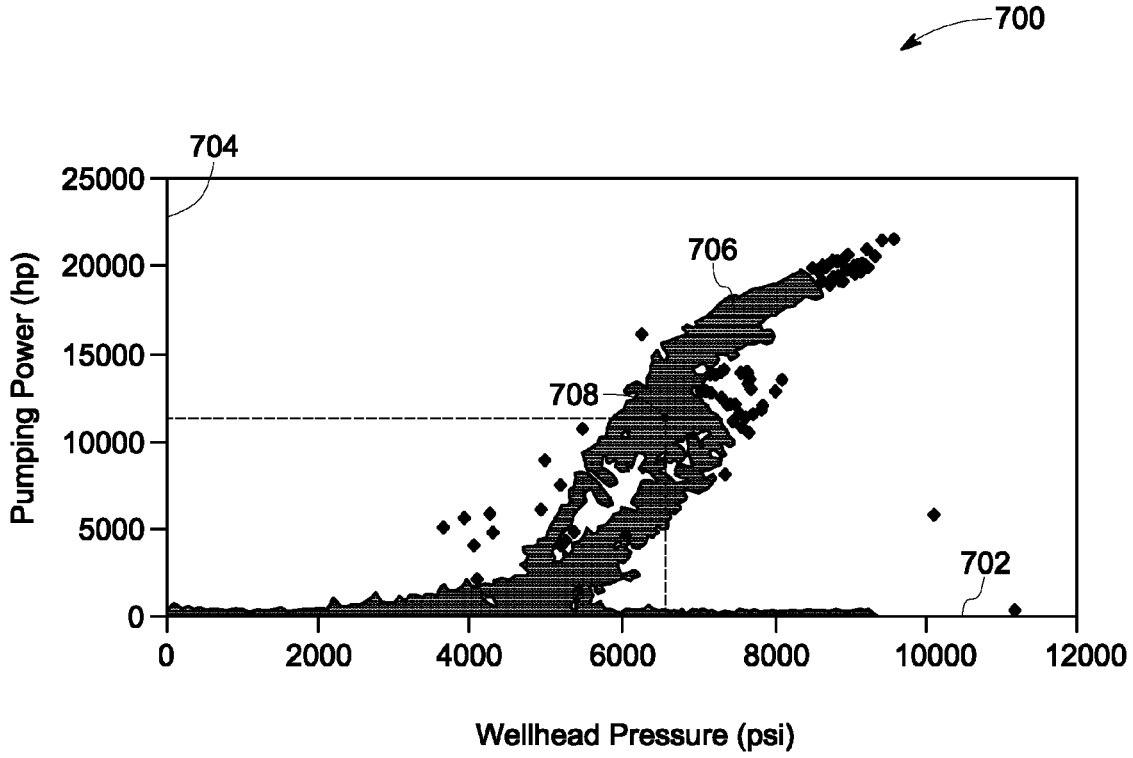
FIG. 7 is a graph illustrating an operating characteristics of a distributed pumping system in accordance with an exemplary embodiment.

FIG. 7 is a graph 700 illustrating an operating characteristics of a wellhead observed during operation of the pumping system in accordance with an exemplary embodiment. The graph 700 includes an x-axis 702 representative of well head pressure and a y-axis 704 representative of power of the pumping system. The graph includes a scatter plot 706 of fracking data points observed for five days. The data points on the scatter plot may be used as reference data for determining health of a pumping system and an embodiment of such a technique is explained herein. The data points of the scattered plot 706 are stored in the database of the health module. A point 708 on the scatter plot corresponds to an equivalent of measured operating point of a pumping system at one time instant.

Figure 8:
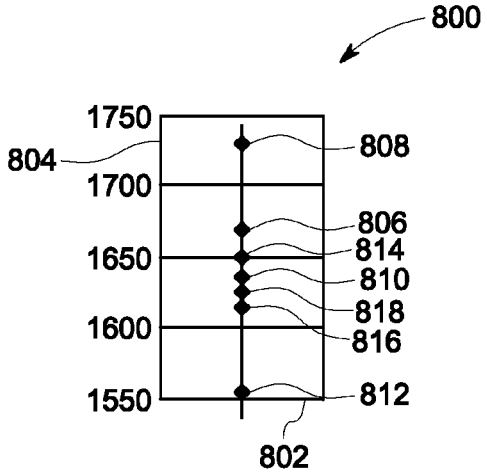
FIG. 8 is a graph illustrating determination of a plurality of health parameters corresponding to a plurality of pump-units in accordance with an exemplary embodiment.

FIG. 8 is a graph 800 illustrating contribution of a plurality of pump-units towards a measured operating point in accordance with an exemplary embodiment. The graph 800 includes an x-axis 802 representative of the well head pressure and y-axis 804 representative of power output of the pump-unit. The graph 800 includes a plurality of health parameters represented by points 806, 808, 810, 812, 814, 816, 818 corresponding to pumping power of the plurality of pump-units. In the illustrated embodiment, seven pump-units are considered but a different number of pump-units may be considered in other embodiments. The plurality of pumping powers corresponding to the plurality of data points are estimated based on the operating parameters of the pump-units. In one embodiment, the current drawn by each of the pump-unit and the supply voltage are used to determine pumping power of the corresponding pump-unit. The pumping powers of the plurality of pump-units are distributed around an average value represented by the point 810. The point 810 is determined by the reference data point 708 of the FIG. 7.

Figure 9:
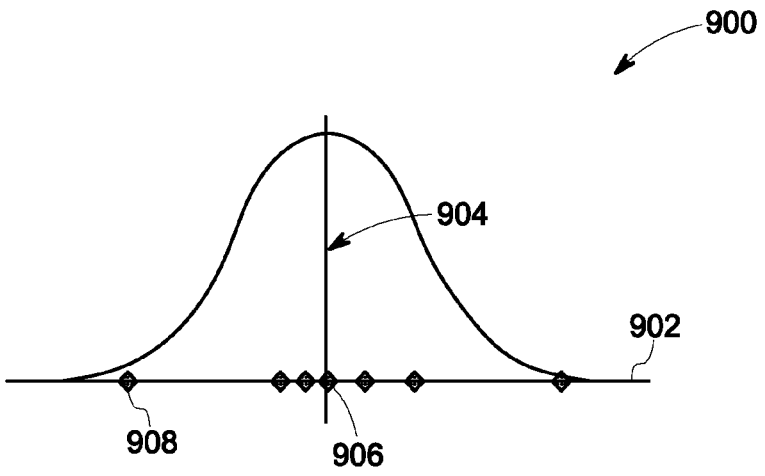
FIG. 9 is a graph of a probability distribution curve used to determine health index in accordance with an exemplary embodiment.

FIG. 9 illustrates a technique for performing a statistical comparison of a plurality of health parameters using a curve 900 in accordance with an exemplary embodiment. The curve 900 is a probability distribution corresponding to the plurality of pumping powers values in accordance with an exemplary embodiment. The graph 900 includes an x-axis 902 representative of data values and a y-axis 904 representative of corresponding probability distribution function. In the illustrated embodiment, a Gaussian distribution is selected and it should be noted that any other probability distribution function may be selected to fit the plurality of pumping power values. The plurality of pumping power values represented by the plurality of points 806, 808, 810, 812, 814, 816, 818 are used as the plurality of health parameters corresponding to the plurality of pump-units. In general, any other statistical technique may be used for comparison of the plurality of health parameters.

A health index for the pumping system is determined based on the plurality of health parameters. In one exemplary embodiment, the health index is determined as a mean of the plurality of health parameters. In another embodiment, the health index of the pumping system is determined as the minimum of the plurality of health parameters. A deviation value corresponding to each of the plurality of pump-units is determined based on the statistical comparison. In one embodiment, the deviation is measured in terms of number of standard deviations of the probability distribution. It should be noted herein that the deviation value of (or a function of the deviation value of) a pump-unit may be used as the health index for the pump-unit. A point 906 is representative of the average value of the distribution function. A health index value is determined for each of the pump-unit based on a distance between each of the plurality of points 806, 808, 810, 812, 814, 816, 818 from the average value 906. As an example, the point 908 away from the average value 906, has a greater deviation value and corresponds to a pump-unit having poor health.

In an exemplary embodiment, where speed value and motor voltage values of each of the plurality of pump-units are available, a motor health index representative of health of electrical motor and a pump health index representative of health of mechanical pump may be determined. In one embodiment, the motor health index, referred herein as 'drive index', is a normalized torque value determined based on the motor voltage value. The pump health index, referred herein as 'injectivity index', is a normalized pressure contribution of a mechanical pump to the well head pressure. The injectivity index is determined based on the speed of the pump. The health index of the pumping system is determined as a product of the drive index of the motor and the injectivity index of the mechanical pump.

Figure 10:
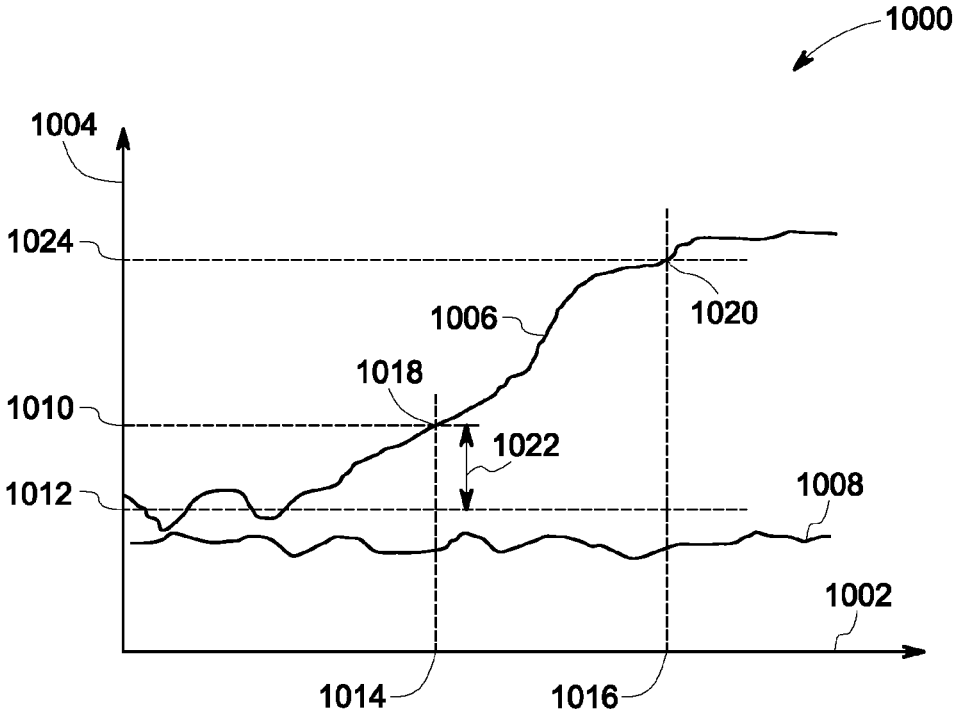
FIG. 10 is a graph illustrating variation of operating parameters corresponding to a pair of pump-units in accordance with an exemplary embodiment.

FIG. 10 is a graph 1000 illustrating working of a protection system in accordance with an exemplary embodiment. The graph 1000 includes an x-axis 1002 representative of time and a y-axis 1004 representative of amplitude of an operating parameter of the pumping system. The graph includes two curves 1006, 1008 representative of the operating parameter corresponding to two pump-units of the pumping system. The curve 1006 corresponds to a faulty pump-unit with an abnormal increase in the value of the operating parameter. The curve 1008 corresponds to a healthy pump-unit having operating parameter values around a normal value represented by point 1012. The faulty pump-unit triggers a protective relay at a point 1020 on the curve 1006 when the value of the operating parameter exceeds a pre-set value represented by point 1024 at a time instant represented by point 1016. In the exemplary embodiment, the operating parameter of the faulty pump-unit is compared with the operating parameter of the healthy pump-unit. The protective relay of the faulty pump-unit is triggered at a point 1018 on the curve 1006 when the value of the operating parameter exceeds a value 1010 at a time instant 1014. At the point 1018, the operating parameter of the faulty pump-unit deviates from the operating parameter of the healthy pump-unit by a value represented by an arrow 1022. As an example, a normal protection relay may isolate a faulty pump-unit when the current flow exceeds 200% of nominal rated current. The disclosed techniques able to isolate the faulty pump-unit by noticing a 20% imbalance with respect to a healthy pump-unit. The disclosed technique enables sensitive protection mechanism and helps to prevent catastrophic failure of pumping system.

Figure 11:
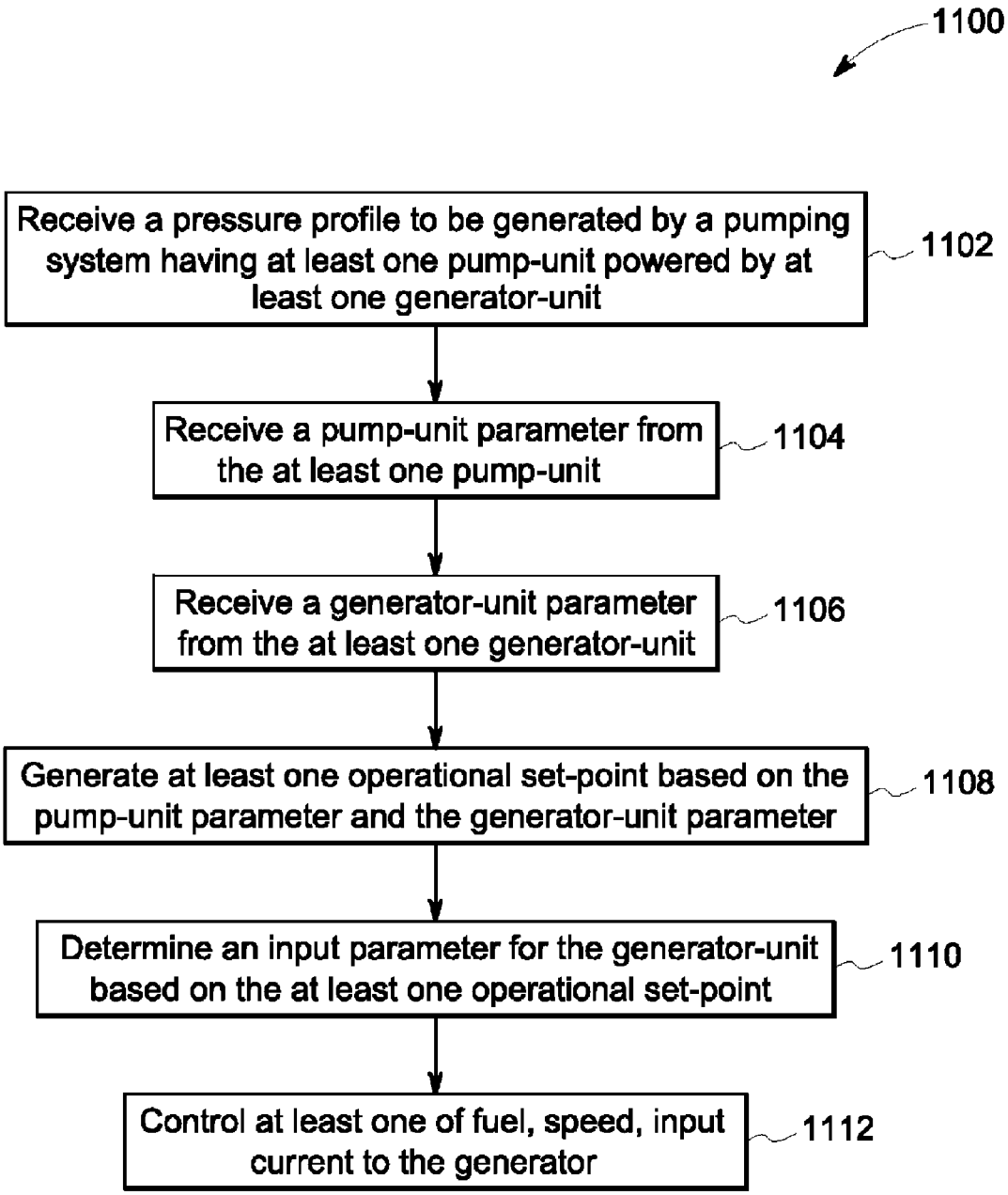
FIG. 11 is a flow chart of a method of power management of pumping system in accordance with an exemplary embodiment.

FIG. 11 is a flow chart 1100 of a method for power management of a plurality of pump-units powered by a pumping system having a plurality of generator-units in accordance with an exemplary embodiment. The method includes receiving a pressure profile to be generated by the pumping system 1102. The at least one pump-unit includes a pump driven by a corresponding motor. The at least one generator-unit includes a generator powered by a corresponding prime mover. The method also includes receiving a pump-unit parameter from the at least one pump-unit 1104, wherein the pump parameter is representative of pressure generated by one or more pumps. The pump-unit parameter comprises at least one of a pump parameter and a motor parameter. The pump parameter includes, but not limited to, flow value and an injection pressure value from the one or more pumps. The method further includes receiving a generator-unit parameter from the at least one generator-unit 1106, wherein the generator-unit parameter is representative of an operating parameter of one or more generator-units. The generator-unit parameter comprises at least one of a prime mover parameter and a generator parameter. The generator parameter includes, but not limited to, a speed value, a power value, a voltage value, and a current value from one or more of the at least one generator. The method includes generating an operating set-point 1108 corresponding to the pumping system based on the pump parameter and the generator parameter. In one embodiment, the generating comprises estimating the motor parameter and the generator parameter based on a model. The operating set-point is determined based on model based estimates of the pump-unit parameter and the generator-unit parameter. The operating set-point is one of at least one operating set-point corresponding to the at least one pumping system. The method includes determining an input parameter for at least one generator-unit among a plurality of generator-units 1110 based on the at least one operating set-point. Each of the at least one operating set-point comprises at least one of an operating pressure, and an operating flow corresponding to the at least one pump. The operating set-point may include one or more of an output current, an output voltage, and speed of the generator, an input current, an input voltage, an input power, and speed corresponding to one or more motors of the pumping system, and estimated injection pressure of one or more individual pumps of the pumping system. The input parameter for the generator-unit includes, but not limited to, a fuel amount to the prime mover, and an excitation current to the generator. The determining the input parameter comprises controlling a fuel input to the at least one prime mover 1112. The determining the input parameter also includes controlling a speed of the prime mover. The determining the input parameter also comprises controlling excitation current of the at least one generator.

Figure 12:
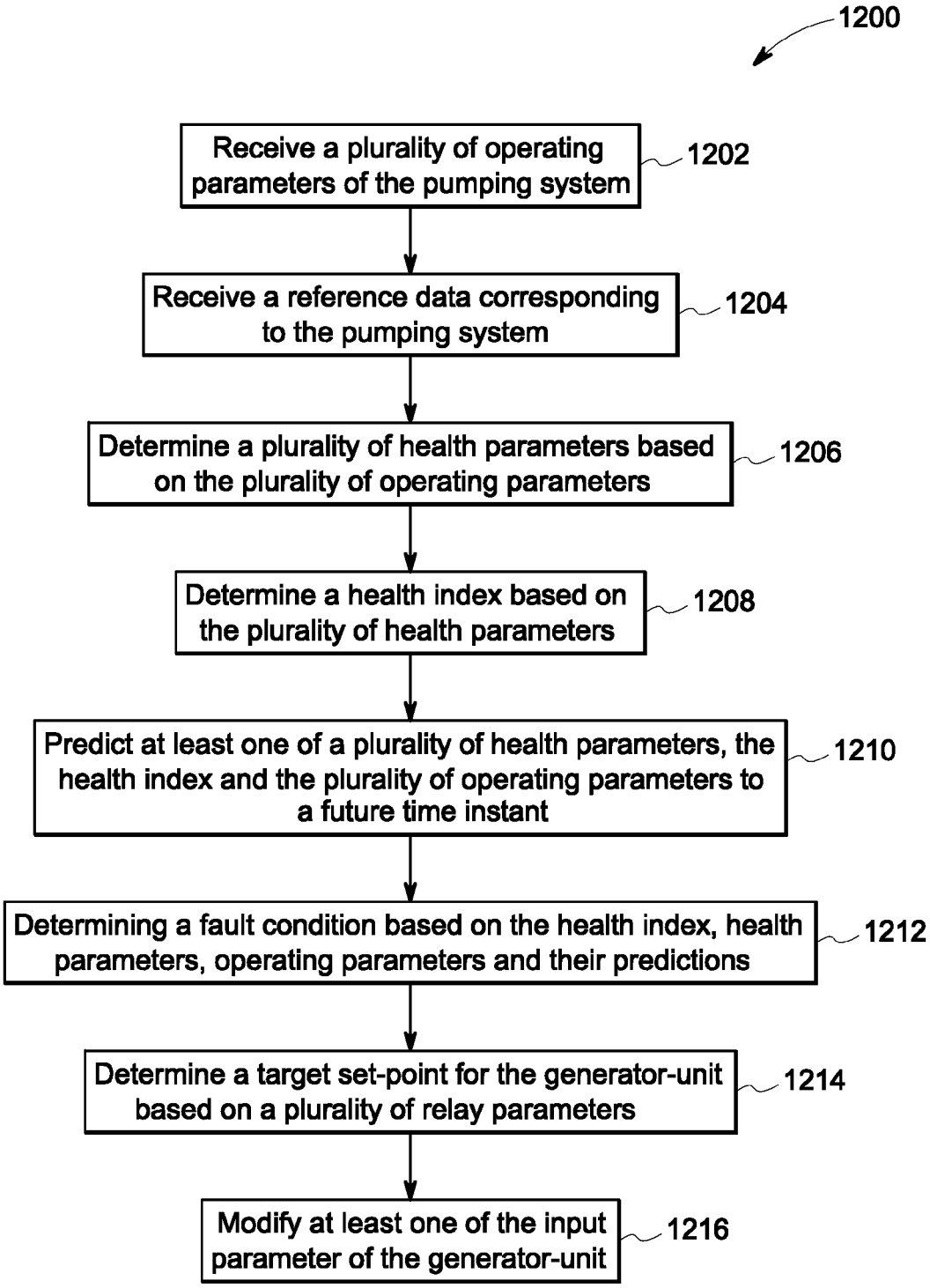
FIG. 12 is a flow chart of a method of health monitoring for a pumping system in accordance with an exemplary embodiment.

FIG. 12 is a flow chart 1200 of a method for health monitoring a plurality of pump-units in accordance with an exemplary embodiment. The method includes receiving a plurality of operating parameters of a pumping system. The operating parameters include pump-unit parameter corresponding to at least one pump-unit and a generator-unit parameter corresponding to a generator-unit of the pumping system 1202. The pump-unit parameter comprises at least one of an injection pressure value, and a flow value related to the pump of the pump-unit and at least one of a current, a voltage, a speed of the motor of the pump-unit. The generator-unit parameter is at least one of a current value, a voltage value, a speed value, and a power value. The method also includes receiving a reference data from a database corresponding to the pumping system 1204. The method also includes determining a plurality of health parameters based on the plurality of operating parameters 1206. In one embodiment, the plurality of operating parameters is determined based on a model of the pumping system. The model of the pumping system may be one of a physical, mathematical and a data driven model. The plurality of health parameters comprise a number of real values representing a rotor failure, a stator failure, a winding insulation failure, and a bearing failure of a generator. The plurality of health parameters also represent a rotor failure, stator failure, winding insulation failure, a bearing failure, a mechanical failure and an electrical failure of a motor, and a mechanical failure, or a bearing failure of the pump. The method also includes determining a health index corresponding to the pumping system based on the plurality of health parameters 1208. The method further comprises predicting at least one or a health index, one or more operating parameters, one or more health parameters at a future time instant based on their values at present and past time instants 1210. In one embodiment, the health index is determined based on an average value of the plurality of health parameters. In another embodiment, the health index is determined based on a minimum value of the plurality of health parameters. In other embodiments, a sum, a product, or any other statistical parameter based on one or more of the plurality of health parameters may be determined as the health index. The method further includes determining a fault condition corresponding to a pump-unit based on the health index, the plurality of operating parameters, the plurality of health parameters and their predicted values 1212. The method further includes receiving one or more relay parameters from one or more of the protection relays of the pump-units and determine a target set-point of the generator-unit 1214. The method further includes modifying one or more input parameters of the generator unit based on the one or more health parameters and the target set-point for continued operation of the pumping system 1216. More specifically, the modifying refers to generator excitation current variation, and variation of prime mover fuel amount.

While the above-identified drawings set forth particular embodiments, other embodiments of the present invention are also contemplated, as noted in the discussion. In all cases, this disclosure presents illustrated embodiments of the present invention by way of representation and not limitation. Numerous other modifications and embodiments can be devised by those skilled in the art which fall within the scope and spirit of the principles of this invention.

The invention claimed is:

1. A method, comprising:

receiving a pressure profile to be generated by a pumping system, wherein the pumping system comprises at least one pump-unit powered by at least one generator-unit;

receiving a pump-unit parameter from at least one pump-unit, wherein the pump-unit parameter is representative of an operating parameter of the pump-unit;

receiving a generator-unit parameter from at least one generator unit, wherein the generator-unit parameter is representative of an operating parameter of the at least one generator-unit;

generating an operating set-point corresponding to the at least one generator-unit based on the pump-unit parameter and the generator-unit parameter, wherein the operating set-point is one of at least one operating set-point corresponding to the at least one generator-unit; and determining an input parameter for the at least one generator-unit based on the at least one operating set-point.

2. The method of claim 1, wherein the receiving the pump-unit parameter comprises receiving a pump parameter from a pump and a motor parameter from a motor, wherein the motor drives the pump in the pump-unit.

3. The method of claim 1, wherein the receiving the generator-unit parameter comprises receiving a generator parameter from a generator of the generator-unit.

4. The method of claim 1, wherein the receiving pump-unit parameter comprises estimating at least one of a flow value and an injection pressure value corresponding to the at least one pump-unit based on a wellhead pressure.

5. The method of claim 1, wherein the generating comprises estimating the operating set-point based on model based estimates of pump-unit parameter and the generator-unit parameter.

6. The method of claim 1, wherein the operating set-point comprises one or more of an output current, an output voltage, and speed of the generator, an input current, an input voltage, an input power, and speed corresponding to one or more motors of the pumping system, and estimated injection pressure of one or more individual pumps of the pumping system.

7. The method of claim 1, wherein the determining the input parameter comprises determining a fuel input to a prime mover driving a generator of the at least one generator-unit.

8. The method of claim 7, wherein the determining the input parameter comprises determining an excitation current of the generator powered by the prime mover.

9. The method of claim 8, wherein the determining the input parameter comprises controlling the excitation current of the generator.

10. The method of claim 7, wherein the determining the input parameter comprises controlling the fuel input to the prime mover.

11. A system comprising:

at least one processor and a memory communicatively coupled to the at least one processor via a communications bus;

a signal acquisition module communicatively coupled to a pumping system having at least one pump-unit powered by at least one generator-unit, wherein the signal acquisition module acquires a pump-unit parameter from a pump-unit and a generator-unit parameter from a generator-unit;

a set-point generator communicatively coupled to the signal acquisition module to determine an operating set-point based on the pump-unit parameter and the generator-unit parameter, wherein the operating set-point is one of at least one operating set-point corresponding to the at least one generator-unit; and a power management module communicatively coupled to the set-point generator to receive the at least one operating set-point and determine an input parameter for the at least one generator-unit;

wherein at least one of the signal acquisition module, the set-point generator and the power management module is stored in the memory and executable by at least one processor.

12. The system of claim 11, wherein the signal acquisition module receives a pump parameter from a pump, a motor parameter from a motor, a generator parameter from a generator, and a prime mover parameter from a prime mover, wherein the motor drives the pump in the pump-unit and the prime mover drives the generator in the generator-unit.

13. The system of claim 11, wherein the signal acquisition module estimates at least one of a flow value, and an injection pressure value corresponding to the at least one pump-unit based on a well head pressure.

14. The system of claim 11, wherein the set-point generator determines model based estimates of pump-unit parameter and the generator-unit parameter.

15. The system of claim 11, wherein the set-point generator determines at least one of an output current, an output voltage, an input current, an input voltage, an input power, speed corresponding to one or more motors of the pumping system, and an estimated injection pressure of one or more individual pumps of the pumping system.

16. The system of claim 11, wherein the power management module determines a fuel input to a prime mover driving a generator of the at least one generator-unit.

17. The system of claim 16, wherein the power management module determines an excitation current of the generator.

18. The system of claim 17, wherein the power management module controls the excitation current of the generator.

19. The system of claim 16, wherein the power management module controls a fuel input to the prime mover.

20. A non-transitory computer readable medium having a program to instruct at least one processor to:

receive a pressure profile to be generated by a pumping system, wherein the pumping system comprises at least one pump-unit powered by at least one generator-unit;

receive a pump-unit parameter from the at least one pump-unit, wherein the pump-unit parameter is representative of an operating parameter of the pump-unit;

receive a generator-unit parameter from the at least one generator unit, wherein the at least one generator-unit parameter is representative of an operating parameter of the generator-unit;

generate an operating set-point corresponding to the at least one generator-unit based on the pump-unit parameter and the generator-unit parameter, wherein the operating set-point is one of at least one operating set-point corresponding to the at least one generator-unit; and determine an input parameter for the at least one generator-unit based on the at least one operating set-point.

* * * * *